US006030652A

United States Patent [19]

Hanus

[11] Patent Number: 6,030,652

[45] Date of Patent: Feb. 29, 2000

[54] FOOD BAG FEATURING GUSSET OPENING, METHOD OF MAKING THE FOOD BAG, AND METHOD OF USING THE FOOD BAG

[76] Inventor: John Hanus, 611 Dundee St., Hartland, Wis. 53029

[21] Appl. No.: 09/119,681

[22] Filed: Jul. 21, 1998

Related U.S. Application Data

[60] Provisional application No. 60/054,793, Aug. 5, 1997, and provisional application No. 60/055,929, Aug. 16, 1997.

[51] Int. Cl.[7] ..... B65B 29/68; A23L 1/18

[52] U.S. Cl. ..... 426/107; 426/115; 383/120

[58] Field of Search ..... 426/107, 111, 426/113, 115, 118, 122, 123, 234, 243; 383/120, 211, 207, 66

[56] References Cited

U.S. PATENT DOCUMENTS

| | | | |
|---|---|---|---|
| 3,615,712 | 10/1971 | Keller | 426/113 |
| 4,267,420 | 5/1981 | Brastad | 219/10.55 |
| 4,292,332 | 9/1981 | McHam | 426/111 |
| 4,548,826 | 10/1985 | Watkins | 426/394 |
| 4,571,337 | 2/1986 | Cage et al. | 426/107 |
| 4,691,374 | 9/1987 | Watkins et al. | 383/104 |
| 4,810,844 | 3/1989 | Anderson | 219/10.55 |
| 4,927,648 | 5/1990 | Yivisaker | 426/234 |
| 4,942,050 | 7/1990 | Yivisaker | 426/396 |
| 5,044,777 | 9/1991 | Watkins et al. | 383/100 |
| 5,160,308 | 11/1992 | Peppiatt | 493/235 |
| 5,171,950 | 12/1992 | Brauner et al. | 219/10.55 |
| 5,189,272 | 2/1993 | McDonald et al. | 219/10.55 |
| 5,302,790 | 4/1994 | Turpin | 219/727 |
| 5,326,576 | 7/1994 | Zuege | 426/107 |
| 5,357,086 | 10/1994 | Turpin et al. | 219/732 |
| 5,460,839 | 10/1995 | Archibald | 426/107 |
| 5,461,216 | 10/1995 | McDonald | 219/727 |
| 5,480,372 | 1/1996 | Gwiazdon et al. | 493/437 |
| 5,488,220 | 1/1996 | Freerks et al. | 219/727 |
| 5,498,080 | 3/1996 | Dalea et al. | 383/120 |
| 5,547,284 | 8/1996 | Imer | 383/104 |
| 5,770,839 | 6/1998 | Ruebush et al. | 219/727 |

FOREIGN PATENT DOCUMENTS 2204015A 11/1988 United Kingdom .

*Primary Examiner*—David Lacey
*Assistant Examiner*—Sherry Dauerman
*Attorney, Agent, or Firm*—Snell & Wilmer LLP; Michael K. Kelly

[57] ABSTRACT

A bag for storing and dispensing a food product (e.g., a microwavable popcorn bag, potato chip bag, etc.) includes an improved product access opening. In particular, the bag comprises at least a first gusset on some surface of the bag, the gusset comprising at least two gusset panels and a product access opening ("gusset opening") between the two panels. The gusset opening may be sealed by a number of different methods and mechanisms, e.g., an adhesive, a pull-tab, a perforation, or any other suitable seal which keeps the bag sealed and, further, allows a user easily to unseal the opening to access the food product inside the bag. The gusset opening may be incorporated into many types of food bags, including both microwavable and non-microwavable food bags. If the gusset opening is incorporated into a microwavable food bag (e.g., a popcorn bag), the bag expands in a microwave during cooking and causes the gusset to unfold. The gusset opening also may be partially sealed to provide a vent for hot gases during cooking. After cooking, the user may remove the bag from the microwave oven and unseal the gusset opening. Once unsealed, the gusset panels fold inward and create a barrier between the user's hands and the inside sides of the bag, thereby protecting the user's hands from residual grease remaining on the inside sides of the bag. Furthermore, the bag may comprise a second gusset substantially opposing the first gusset, the second gusset providing a stable base for resting the bag on a substantially flat surface with the gusset opening facing substantially upward. The bag also may be constructed from a flat blank whose longitudinal construction seam is utilized to form at least a portion of the gusset opening.

9 Claims, 10 Drawing Sheets

FOOD BAG FEATURING GUSSET OPENING, METHOD OF MAKING THE FOOD BAG, AND METHOD OF USING THE FOOD BAG

CROSS-REFERENCE TO RELATED APPLICATIONS

This application claims the benefit of U.S. Provisional Application No. 60/054,793 filed Aug. 5, 1997 and U.S. Provisional Application No. 60/055,929 filed Aug. 16, 1997.

FIELD OF THE INVENTION

The invention relates generally to a container for storing and dispensing a food product. More specifically, the invention relates to a container for storing and dispensing a food product while also providing a means for delivering the food product in a manner which is clean and convenient for the user.

BACKGROUND OF THE INVENTION

There are many known containers for storing and dispensing food products, including microwavable bags for storing, cooking and dispensing popcorn. Examples of various bag designs used to cook popcorn in a microwave include: U.S. Pat. No. 5,488,220 issued Jan. 30, 1996 to Randall C. Freerks and Marvin A. Strouth, U.S. Pat. No. 4,810,844 issued Mar. 7, 1989 to Alan R. Anderson, U.S. Pat. No. 5,044,777 issued Sep. 3, 1991 to Jeffrey T. Watkins and Lawrence C. Brandberg, and U.S. Pat. No. 5,326,576 issued Jul. 5, 1994 to John Zuege. These patents are incorporated by reference and include various materials, techniques and configurations currently known in the art and used in the construction of microwavable food bags.

Generally, the above-noted patents describe bags constructed from flat blanks. The blanks are folded into bags containing internally folded sets of panels ("gussets") and sealed ends, typically with one end sealed in a manner which allows easy opening and access to the food contents. Different bag configurations may include different types of folds, seals, and heat enhancers, in the form of susceptors, to help cook the food contents. The combination of folds, seals and optional heat enhancers typically allows for a more complete cooking of the contents (e.g., leaving fewer kernels unpopped).

One feature common to most of the above-mentioned bags is the inclusion of internally folded panels ("gussets"). The gussets fold inwardly, enabling a bag to be folded flat for storage and shipment, and then unfold when the food product inside the bag is cooked and the bag expands. These gusseted panels usually terminate in sealed ends which, in combination, define the structure of an expanded bag after the food has been cooked and gussets have unfolded. Another feature common to most existing microwavable popcorn bags is the use of a partial or weak seal on one end of a bag, allowing a user to open the bag easily once the product has completely cooked and the bag has fully expanded. Specifically, to open the bag the user grasps opposing corner flaps at the end of the bag and pulls the corner flaps apart to unseal an opening at the end of the bag.

When the user takes the bag out of the microwave, he or she typically turns the bag so that the partially sealed end is facing upward, and then pulls the opposing corner flaps away from each other to break the seal. A common problem with many currently known bag designs is that they fail to provide a clean and effective food delivery receptacle. After opening the bag, the user must either transfer the contents of the bag into another container or reach into the bag itself to obtain the contents. When the user reaches inside the bag to access the contents, he or she invariably touches the inside sides of the bag which are coated with the popping oil or lard type material used to cook the product. As a result, the user cannot use the bag as a delivery receptacle without covering his or her hands with grease. Furthermore, if the user tries to set the bag down on a flat surface, the bag invariably falls over and spills the popcorn. It is also important to note that these problems exist when bags known in the art are used as containers for other greasy food products, for example, potato chips. Until now, no effective solution has been provided to eliminate these problems.

Consequently, a need exists to provide an inexpensive and effective bag featuring a product access opening which allows clean and convenient access to a food product contained within.

SUMMARY OF THE INVENTION

In accordance with the present invention as applied to a popcorn bag, or other suitable food product bag, means are provided for protecting a user's hands from the greasy residue on the inside sides of the bag when accessing a food product therein, and preferably allowing the bag to rest in a stable position on a flat surface. The invention thereby allows a food bag to be used more effectively as a dispensing receptacle for the food. Moreover, preferred embodiments of the invention for the most part can be manufactured using existing bag production machinery and technology.

While exemplary embodiments will be described below, the invention generally provides a food product access opening on a bag, wherein the opening ("gusset opening") preferably is created between any two or more panels of a gusset formed in the bag. The gusset opening may comprise a releasably sealed opening or a mechanism which facilitates the creation of an opening. The gusset opening thereby secures the food product within the bag and, further, allows a user to easily unseal the gusset opening to gain access to the food product inside the bag. The gusset opening may be incorporated into many types of bags used to store and dispense food products, including both microwavable and non-microwavable food bags.

To utilize a microwavable food bag comprising a gusset opening, the user places the bag into a microwave oven and cooks the food contents for an appropriate period of time. Once the food has been cooked (e.g., after the popcorn has popped) and the bag is in its fully expanded condition, the user removes the bag from the microwave oven and may rotate the bag so that the expanded gusset of the bag which comprises the gusset opening is now in the top-most position. The user then may unseal the gusset opening to gain access to the food contents inside the bag.

Once the bag has been opened, the separated panels provide a barrier between the user's hands and the greasy residue on the inner surfaces of the bag when the bag is used as the delivery receptacle. Moreover, the bag may also include a second gusset substantially opposing the gusset comprising the gusset opening, the second gusset providing a stable base so the user can rest the bag on a substantially flat surface (e.g., a table) such that the gusset opening faces substantially upward towards the user.

BRIEF DESCRIPTION OF THE DRAWING FIGURES

The foregoing as well as other objects and advantages of the invention will become apparent from the following detailed description when considered in conjunction with accompanying drawings, wherein like numerals denote like elements, and:

DETAILED DESCRIPTION OF THE PREFERRED EMBODIMENTS

Figure 5:
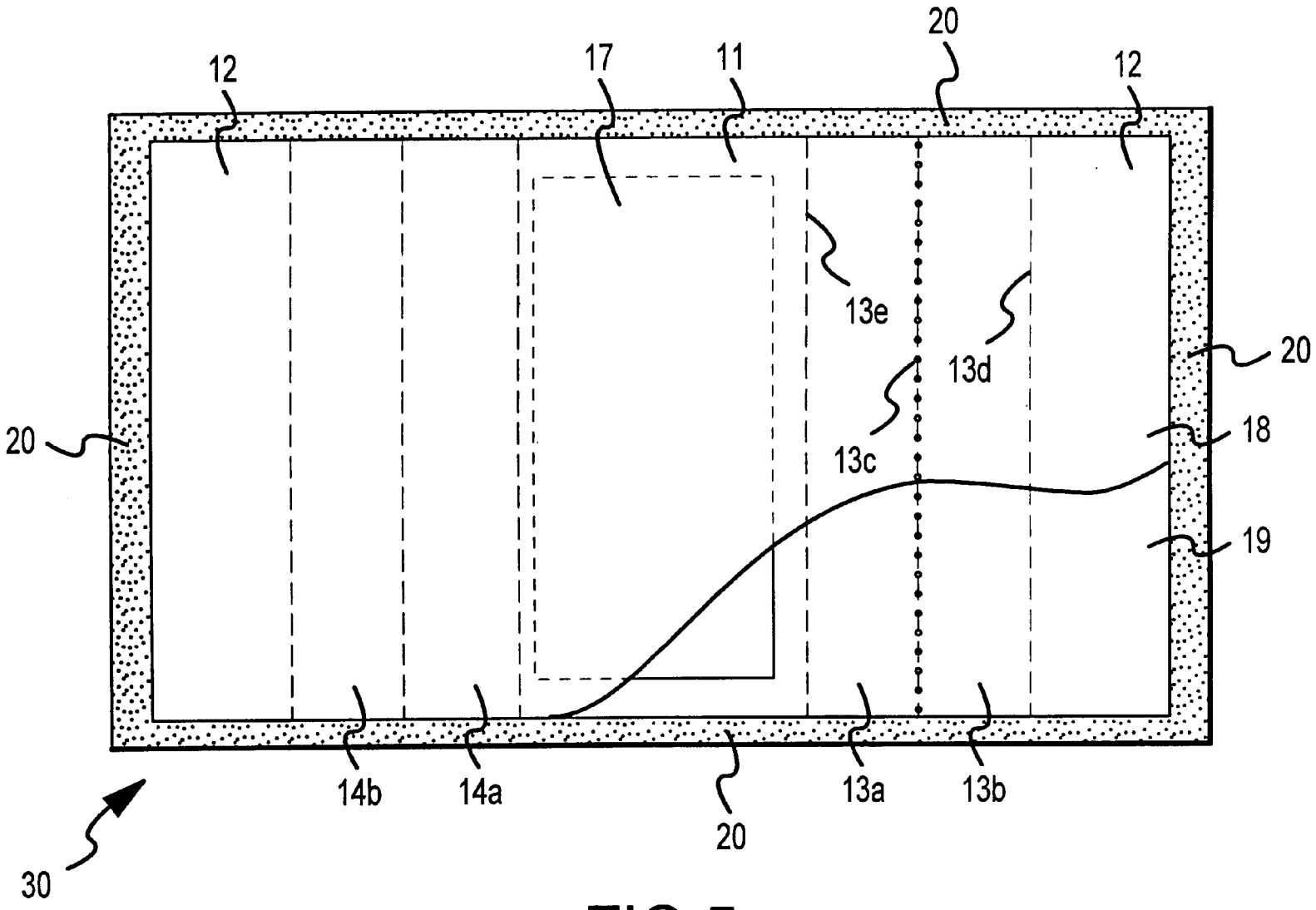
FIG. 5 is a top perspective view of the invention in its flat blank configuration, prior to being folded and assembled to make the bag of FIG. 1.
Figure 6:
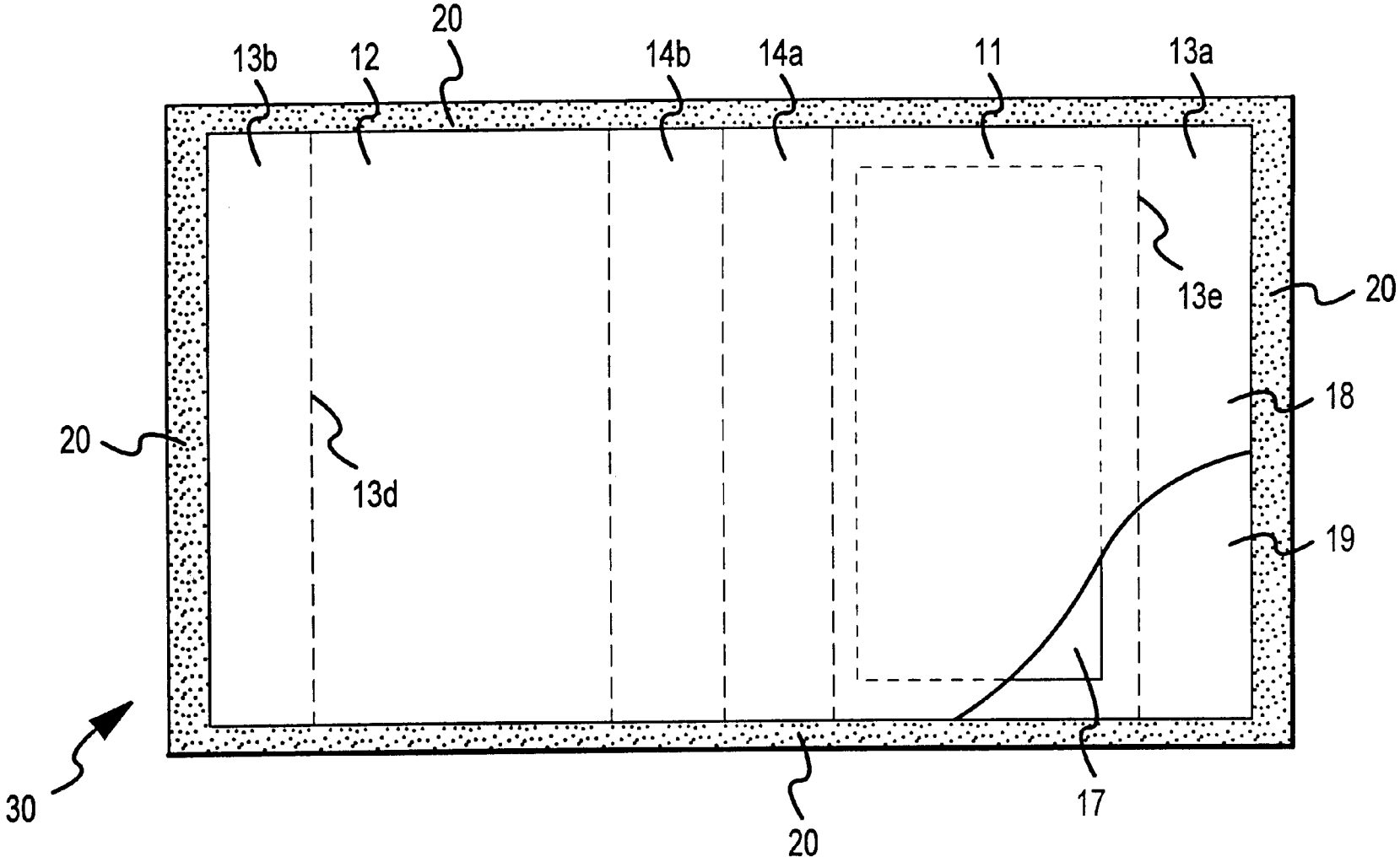
FIG. 6 is a top perspective view of the invention in its flat blank configuration, prior to being folded and assembled to make the bag of FIG. 2.
Figure 7:
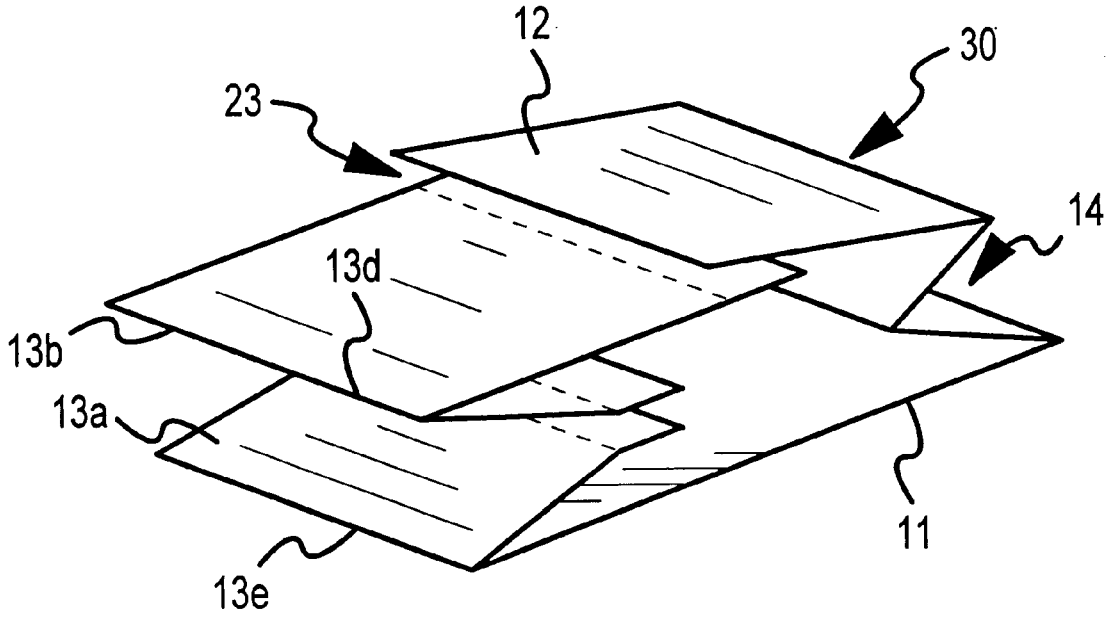
FIG. 7 is a fragmentary perspective view of the flat in FIG. 5 after it partially has been folded into operative position.
Figure 8:
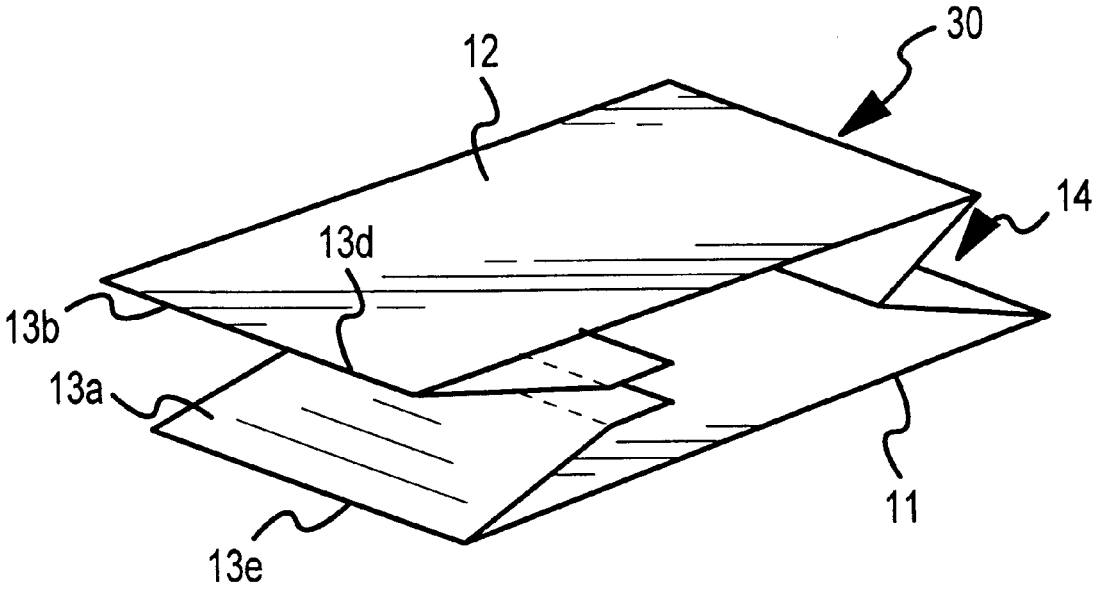
FIG. 8 is a fragmentary perspective view of the flat in FIG. 6 after it partially has been folded into operative position.

Referring to the figures, a preferred embodiment of the invention is indicated generally as incorporated into a microwavable food bag 10 in FIGS. 1–8. While a preferred embodiment of gusset opening 70 illustrated herein may be incorporated into a microwavable food bag, it is important to note that gusset opening 70 may be incorporated into many types of food bags, including both microwavable and non-microwavable food bags. Microwavable food bag 10 suitably includes a pair of generally rectangular front and back face panels 11 and 12 respectively, preferably joined at opposite side edges by gussets 13 and 14. As an example, gussets 13 and 14 may each comprise a set of first and second gusset panels 13*a*, 13*b*, and 14*a*, 14*b* respectively, wherein each set of panels can be folded inwardly along fold lines 13*c* and 14*c*, respectively. These gusset panels may thereby create accordion type pleats on each side of the bag, between the front and back face panels 11 and 12, when the bag is folded and collapsed as depicted in FIGS. 7 and 8. Furthermore, gusset 13 advantageously includes a gusset opening 70 along inner fold line 13*c* for allowing access to the food contents within the bag, as discussed further below. Finally, the front and back face panels 11 and 12 and gusset panels 13*a*, 13*b*, and 14*a*, 14*b* may be pressed together at both ends 15 and 16, and adhesively sealed to close and seal both ends 15 and 16 of bag 10.

As illustrated in FIGS. 5 and 6, bag 10 may include a conventional heat enhancer. One preferred type of heat enhancer is a microwave susceptor 17, suitably positioned in front face panel 11. In use, bag 10 may be placed into a microwave oven such that face panel 11 is on the bottom, allowing the food contained in bag 10 to rest on, or closely adjacent to, susceptor 17 to facilitate cooking.

Figure 3:
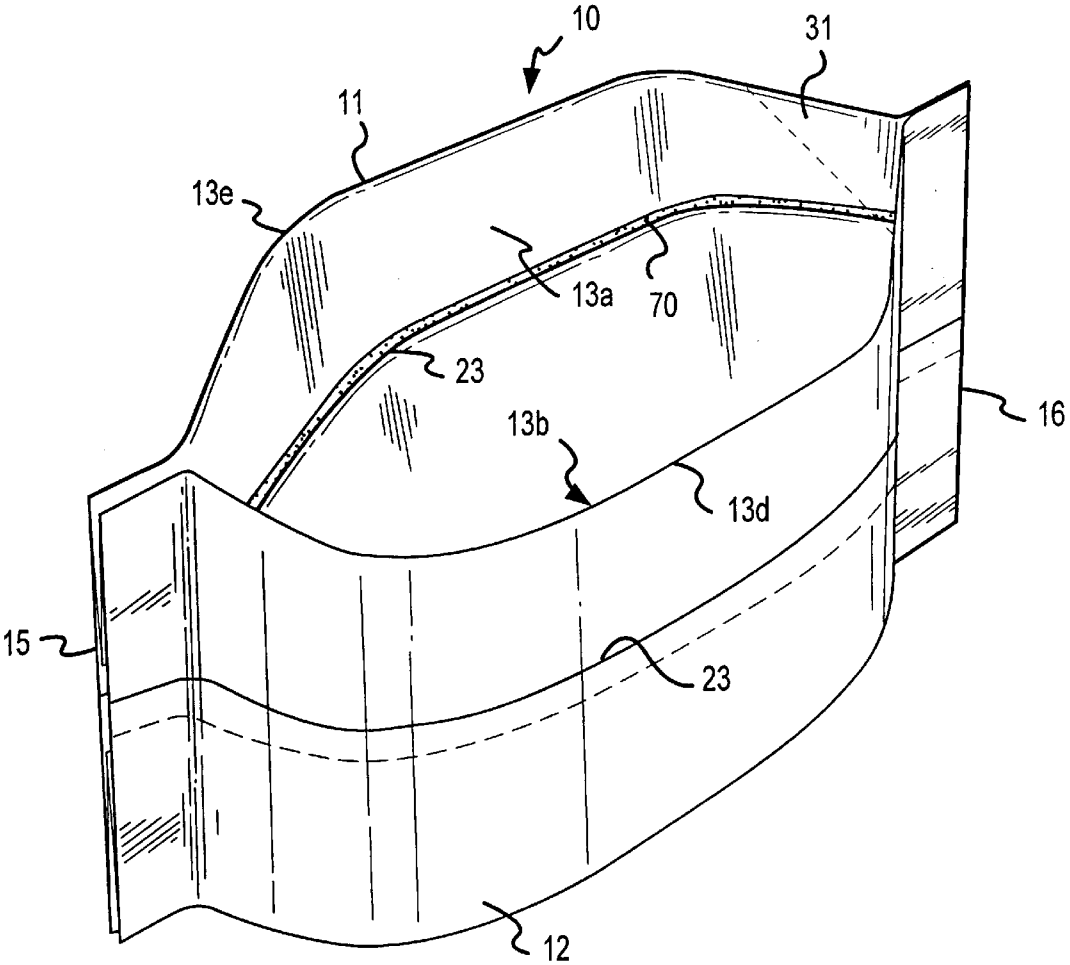
FIG. 3 is a perspective view of the bag in FIG. 1 wherein the gusset opening has been opened and rotated to the top-most position, facilitating usage of the bag as a food product delivery receptacle.
Figure 4:
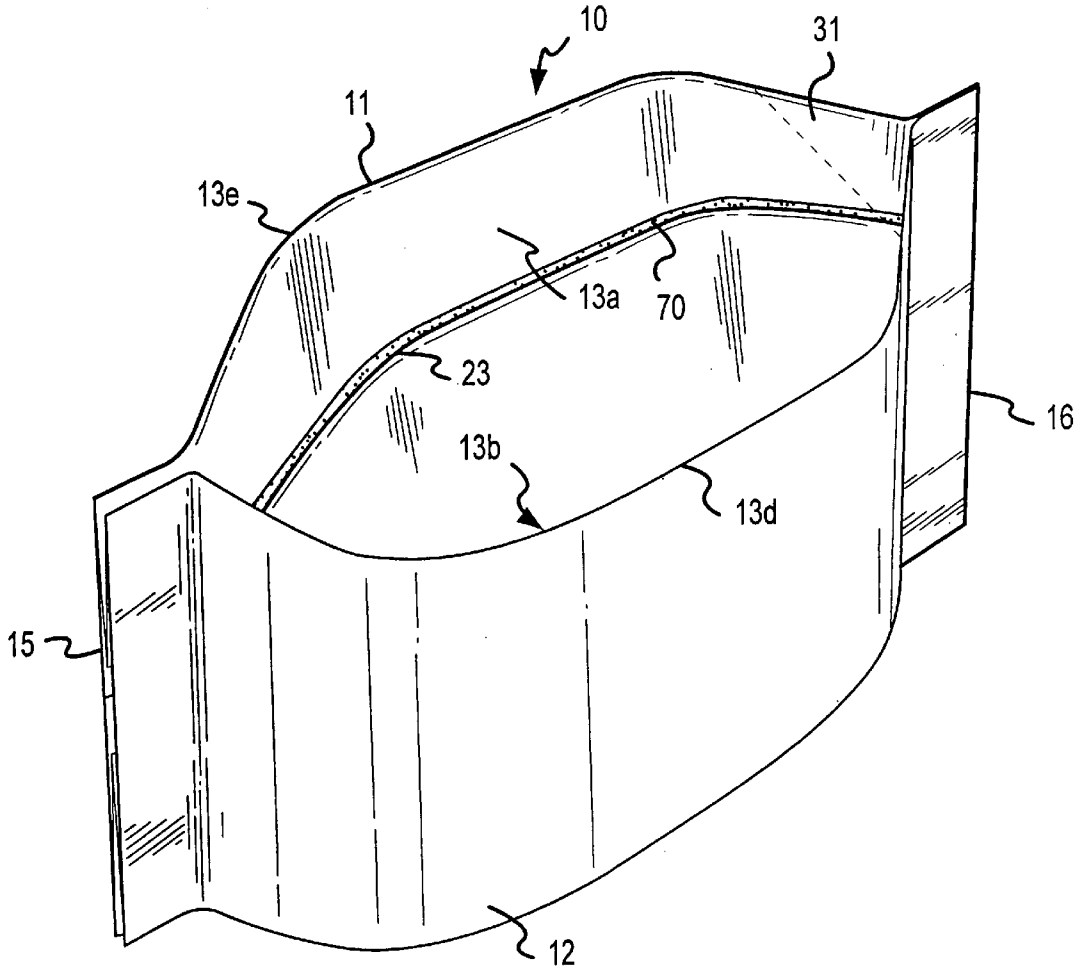
FIG. 4 is a perspective view of the bag in FIG. 2 wherein the gusset opening has been opened and rotated to the top-most position, facilitating usage of the bag as a food product delivery receptacle.

As the food contained in the bag cooks and gases are created, the front and back face panels 11 and 12 suitably move away from each other. As the bag expands, the first and second sets of gusset panels 13*a*, 13*b* and 14*a*, 14*b* preferably unfold along fold lines 13*c* and 14*c* respectively, thereby increasing the interior volume of the bag. Once the product has been cooked for some appropriate period of time, a user may remove bag 10 from the microwave oven and rotate bag 10 so that gusset opening 70 is in a top-most position as shown in FIGS. 3 and 4. One skilled in the art will quickly recognize that gusset opening 70 may comprise a releasably secured opening or a mechanism which allows a user to create an opening between panels 13*a* and 13*b*. Accordingly, gusset opening 70 will be described herein as "sealed" when it comprises a releasably secured opening which has not been released, or a mechanism which facilitates the creation of an opening which has not been so deployed. Further, gusset opening 70 will be described herein as "unsealed" when it comprises a releasably secured opening which has been released, or a mechanism which facilitates the creation of an opening which has been so deployed.

A number of conventional methods and mechanisms are available to implement gusset opening 70. For example, gusset opening 70 may comprise an opening which is releasably secured by an adhesive, a zipper, a zip-lock or any other suitable method for releasably securing an opening in bag 10. For an in-depth discussion of different types of glues and seals known in the art, please see U.S. Pat. No. 5,690,853 issued Nov. 25, 1997 to Jackson et al., which is hereby incorporated by reference. In other possible embodiments, gusset opening 70 may comprise a mechanism which facilitates the creation of an opening between gusset panels 13*a* and 13*b*. Such a mechanism may comprise a pull string, a pull tab, a perforation in bag 10 itself, any other mechanism which may be suitably deployed by a user to create an opening between panels 13*a* and 13*b*.

Once bag 10 has been turned such that gusset opening 70 faces substantially upward, a user can unseal gusset opening 70 between gusset panels 13*a* and 13*b*. Once gusset opening 70 has been unsealed, gusset panels 13*a* and 13*b* preferably fold downwards into bag 10 thereby covering portions of the inside sides of bag 10 near gusset opening 70 as illustrated in FIGS. 3 and 4. One skilled in the art also will recognize that gussets 13 and 14, or any other gusset that may be incorporated into bag 10, may comprise multiple sets of folded panels. For example, a gusset could be formed with four separate panels such that the gusset would resemble a 'W' if viewed from its end. Furthermore, gusset opening 70 could be incorporated into a multi-panel (more than two panels) gusset in a variety of different ways. For example, a multi-panel configuration of gusset 13 could comprise gusset opening 70 between any pair of adjacent gusset panels; or, for example, a multi-panel configuration of gusset 13 could comprise multiple gusset openings 70, each between various adjacent pairs of gusset panels; or, for example, any number of adjacent gusset panels could be removable as a whole to create gusset opening 70. Accordingly, the present invention is in no way limited by the types of gussets that are incorporated into a particular bag, the number of gusset panels a particular gusset has, the number of gusset openings employed in a particular gusset, or the configuration of a particular gusset opening.

In a further preferred embodiment, gusset panels 13*a*, 13*b*, 14*a*, and 14*b* preferably include adhered triangular corners 31 proximate to each area of bag 10 where panels 13*a*, 13*b*, 14*a*, and 14*b* terminate at one or both of sealed ends 15 and 16. Adhered triangular corners 31 suitably secure gusset panels 13*a*, 13*b*, 14*a*, and 14*b* to their respective face panels 11 and 12 proximate to ends 15 and 16, an action which advantageously restricts the outward folding movement of gusset panels 13*a*, 13*b*, 14*a*, and 14*b* when bag 10 is expanding during microwaving. While it is known in the art to use adhered triangular corners 31 to help prevent food contents of bag 10 (e.g., popcorn seeds) from getting stuck in the corners of bag 10, thereby keeping the food contents in close proximity to susceptor 17 during cooking (see Freerks et al., U.S. Pat. No. 5,488,220, issued Jan. 30, 1996), the present invention discloses a new and previously unsuggested use for adhered triangular corners 31. Namely, triangular corners 31 may be used suitably in conjunction with gusset opening 70 to restrict the unfolding action of gussets 13 and 14, thereby advantageously enhancing gusset opening 70 when it is unsealed, providing easier access to the food contents inside bag 10.

Once a user has unsealed gusset opening 70, gusset panels 13*a* and 13*b* preferably fold inwardly toward the inside sides of bag 10. In this configuration, gusset panels 13*a* and 13*b* advantageously cover at least some portion of the inner surfaces of bag 10, thereby protecting the user's hands and fingers from the residual grease and oil remaining on the inside sides of the bag. As discussed above, adhered triangular corners 31 also may be employed to help pull gusset panels 13*a* and 13*b* towards the inside sides of the bag 10, thereby enhancing gusset opening 70.

Figure 9:
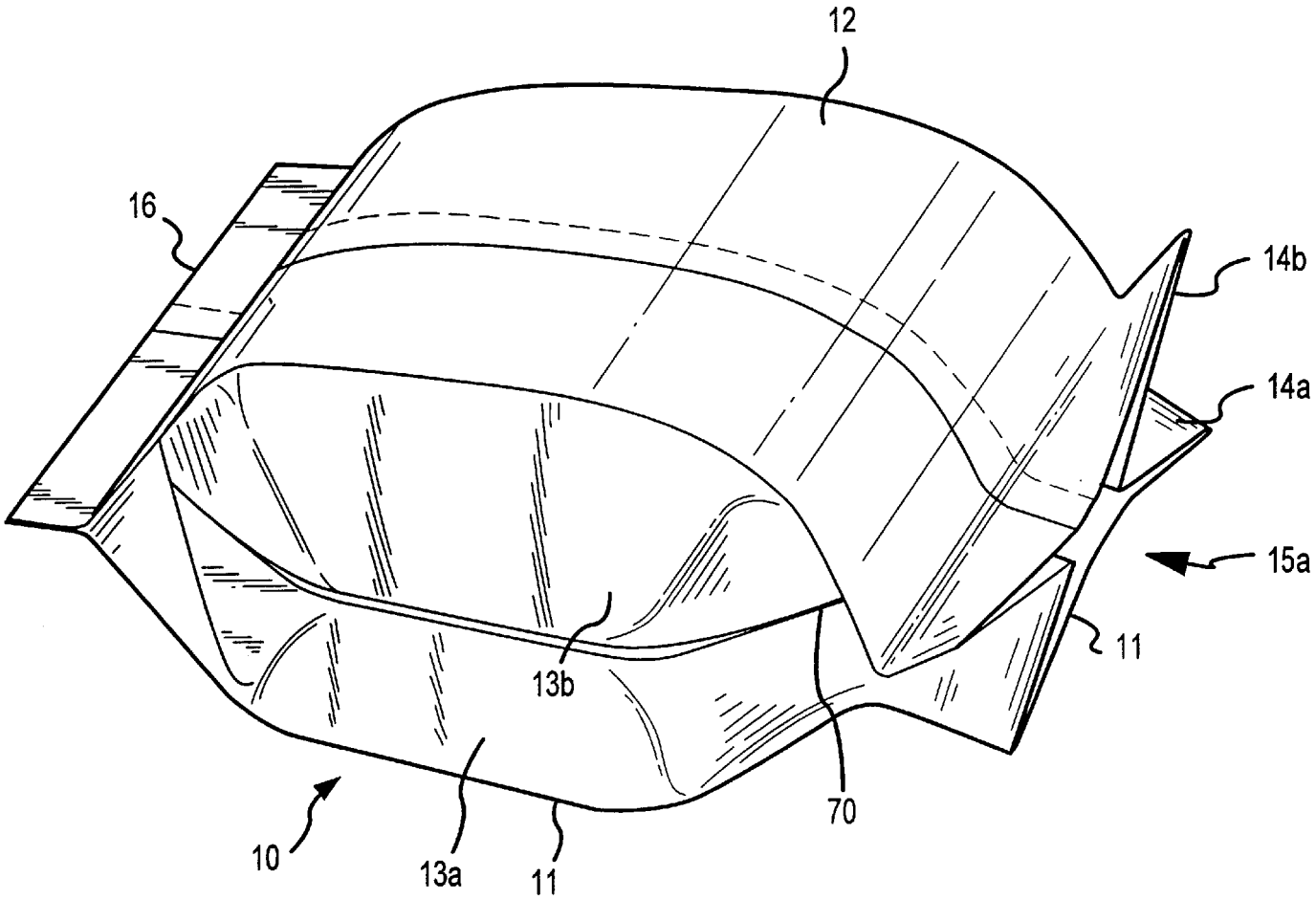
FIG. 9 is a perspective view of the bag of FIG. 1 with an end which is not sealed flat.
Figure 10:
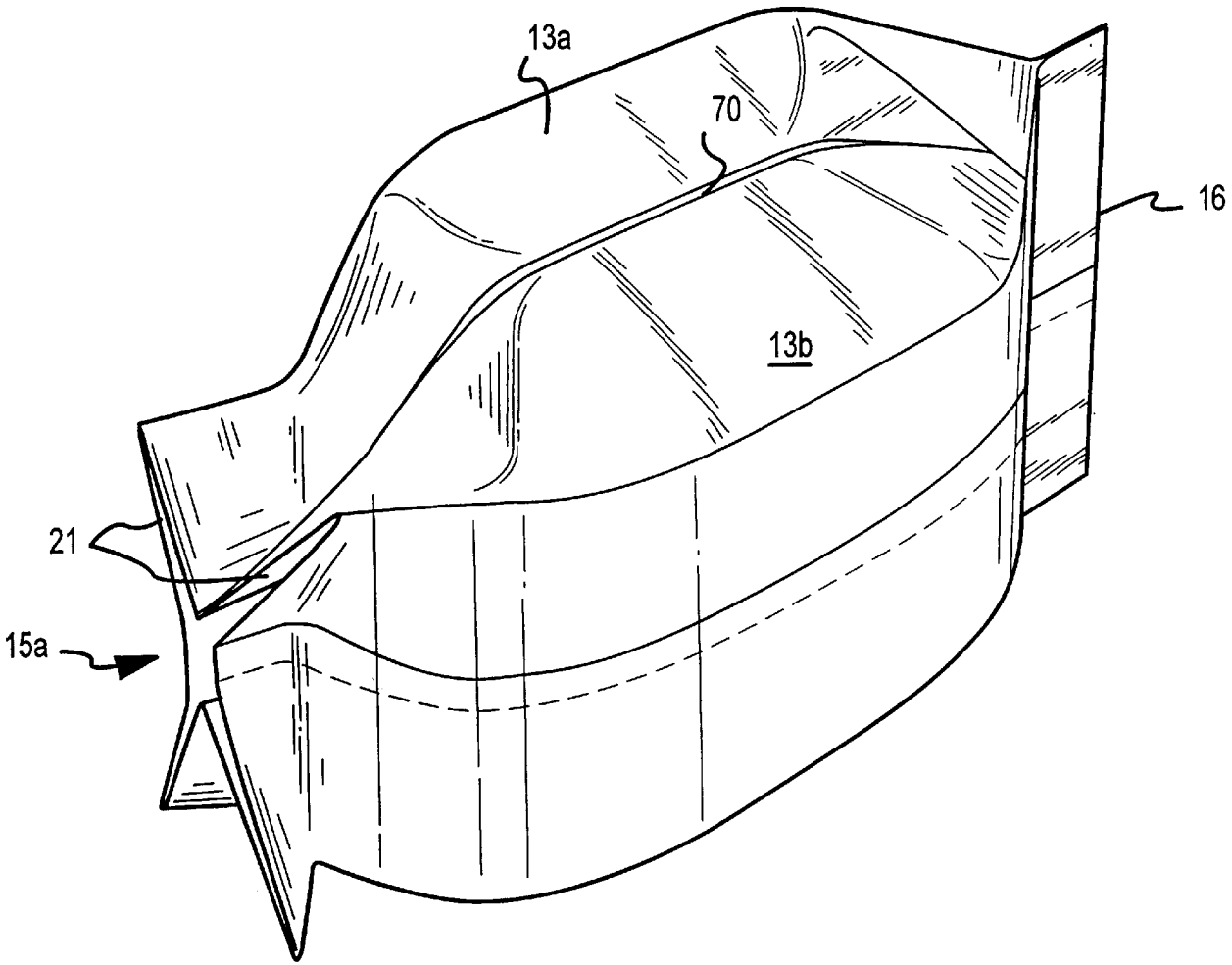
FIG. 10 is a perspective view of the bag of FIG. 3 with an end which is not sealed flat.

Another aspect of a preferred embodiment of the current invention concerns the configuration of bag ends 15 and 16. FIGS. 9 and 10 illustrate the shortcomings of using conventional bag end 15*a* in conjunction with gusset opening 70. In contrast, FIGS. 1–4 illustrate a preferred configuration for bag ends 15 and 16 when used in conjunction with a gusset opening 70. It is important to note, however, that gusset opening 70 can be used with virtually any bag configuration, including bag end 15*a*, and that the configurations noted here are only exemplary preferred embodiments.

In particular, FIG. 9 illustrates a configuration of bag 10 wherein end 16 is sealed flat (as discussed further below), while end 15*a* is shaped like an 'X'. Specifically, in the vicinity of end 15*a*, the inner surfaces of gusset panels 13*a* and 14*a* are adhered to the inner surface of front face panel 11, the inner surfaces of gusset panels 13*b* and 14*b* are adhered to the inner surface of front face panel 12, but the outer surfaces of gusset panels 13*a* and 13*b*, and panels 14*a* and 14*b*, respectively, are not adhered to one another. In this configuration, end 15*a* is shaped like an 'X'. As illustrated in FIG. 10, if 'X'-shaped end 15*a* is combined with gusset opening 70, 'V'-shaped gap 21 is created between gusset panels 13*a* and 13*b* when gusset opening 70 is unsealed, which may allow food to spill out of bag 10 during use.

In contrast, preferred embodiments of bag ends 15 and 16 are illustrated in FIGS. 1–4 wherein both ends 15 and 16 may be sealed flat. Specifically, in the vicinity of each of ends 15 and 16, the outer surfaces of gusset panels 13*a* and 13*b*, and panels 14*a* and 14*b*, respectively, may be suitably adhered to one another. Accordingly, if gusset opening 70 has been rotated to a top-most position and unsealed as illustrated in FIGS. 3 and 4, a rim created along folds 13*d* and 13*e* around gusset opening 70 may be suitably sealed at both ends 15 and 16, thereby completely encircling gusset opening 70 and avoiding the creation of gap 21 as illustrated in FIG. 10. Accordingly, when both ends 15 and 16 are sealed flat, the food product inside the bag may be less likely to spill out of bag 10 once gusset opening 70 has been unsealed.

One skilled in the art also will recognize that bag 10 may incorporate a vent for the release of gases and pressure during cooking. Since, in a preferred embodiment, both ends of bag 10 may be fully sealed, it may be advantageous for a vent to comprise a small unsealed or weakly-sealed portion of gusset opening 70 proximate to ends 15 and/or 16 of bag 10. It is preferable to keep any such vent near end 15 or 16 of bag 10 because, during cooking, ends 15 and 16 of bag 10 are typically higher than the central portion of bag 10. For example, bag 10 may be folded into three relatively equal sections, with the two outer one-third sections folding over the central one-third section. When bag 10 is initially put into a microwave oven, the central section is positioned flat on the oven floor with ends 15 and 16 projecting upwards, creating a 'U' shape if viewed from the side. By keeping any such vents proximate to raised ends 15 and/or 16 of bag 10, the oils and/or lard which typically reside near susceptor 17 in the lower central third of the bag cannot easily leak out through the raised vents during cooking. However, one skilled in the art will quickly recognize that different bag configurations may demand different vent placement in order to minimize oil and lard leakage during cooking. Furthermore, some bag designs may not require any vents at all. In any case, vent placement in no way narrows the scope of the present invention.

Referring now to FIGS. 5 and 6, a preferred construction technique will now be discussed. For a detailed discussion of different construction techniques known in the art, please see U.S. Pat. No. 5,690,853 issued Nov. 25, 1997 to Jackson et al., which has been incorporated herein by reference. Furthermore, please note that the present invention can be constructed by virtually any construction technique known in the art and that the following techniques and configurations are provided simply as exemplary preferred embodiments. Moreover, one skilled in the art will quickly recognize that any particular bag configuration will have a number of corresponding construction techniques, and that the exemplary techniques described herein in no way limit the number of bag configurations that may incorporate gusset opening 70. Bag 10 preferably is constructed from flat blank 30. Flat blank 30, which eventually will be folded into bag 10, may utilize single or multiple ply construction. For example, flat blank 30 may include an inner grease-resistant layer 18 and an outer machine-finished paper layer 19 for receiving high quality graphics. Each layer of flat blank 30 further may comprise a material of single or multiple ply construction. Susceptor 17 may be suitably positioned between layers 18 and 19 and preferably extended over substantially the entire central portion of the front panel 11. Strips of adhesive 20 then may be applied along the edges of flat blank 30 and used to seal the edges when the respective panels of flat blank 30 are folded upon one another and pressed together to create bag 10. Adhesive strips 20 may comprise any suitable commercially available material and may be thermosetting, thermoplastic, or sealable through other appropriate adhesive means, so long as the seals remain intact and do not open during or after cooking of the food product except in an area which might define a pressure vent or gusset opening.

As may be practiced, but not to be considered a limiting construction technique, bag 10 may be made in stages. For example, starting with a flat blank 30 comprising multiple layers, suitable graphics first may be printed on outer layer or ply 19, which then may be laminated to inner layer 18 with susceptor 17 placed in between. Flat blank 30 then may be suitably placed on a bag machine and liquid adhesive may be applied to form adhesive strips 20 and, if incorporated, adhered triangular corners 31. The panels of flat blank 30 then may be folded over one another and pressed together to form gussets 13 and 14, front face panel 11, back face panel 12, and one sealed end, for example, end 15. Following this initial folding and sealing of flat blank 30 into bag 10, bag 10 is in a flattened state with end 15 sealed and end 16 unsealed. Bag 10 then may be filled with a food product (e.g., unpopped popcorn) through unsealed end 16. Before placing the food product into bag 10, approximately one-third of the length of bag 10 from the now sealed end 15 may be folded into overlying relationship with the central section of bag 10 to help keep the food product in the area of susceptor 17. After bag 10 has been filled with the food product, unsealed end 16 then may be closed and sealed. The approximately one-third section of bag 10 adjacent to newly sealed end 16 then may be folded over the central section of bag 10 to retain the food in the central section of bag 10 adjacent to susceptor 17.

Figure 1:
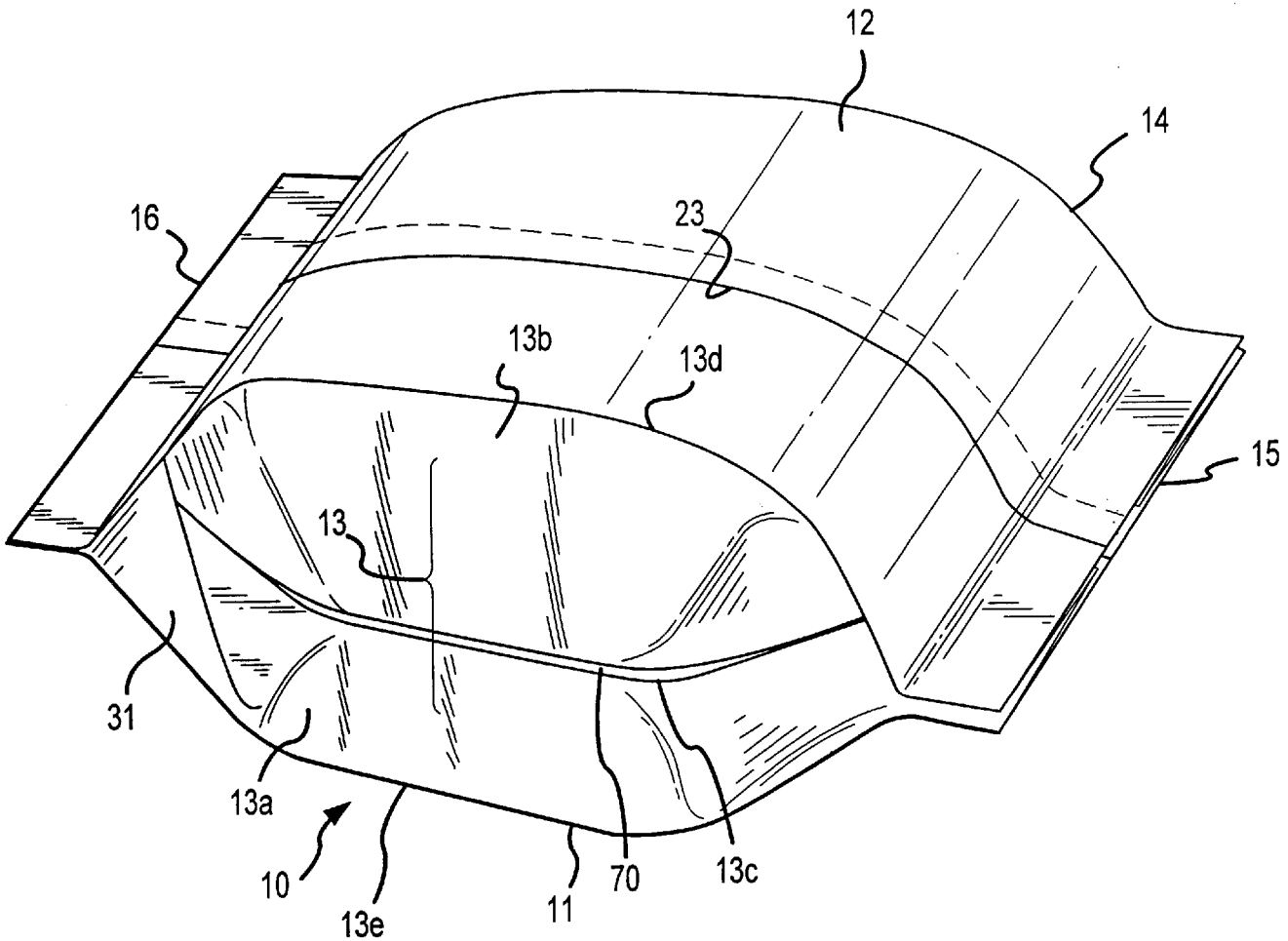
FIG. 1 is a perspective view of a food bag incorporating a gusset opening.
Figure 2:
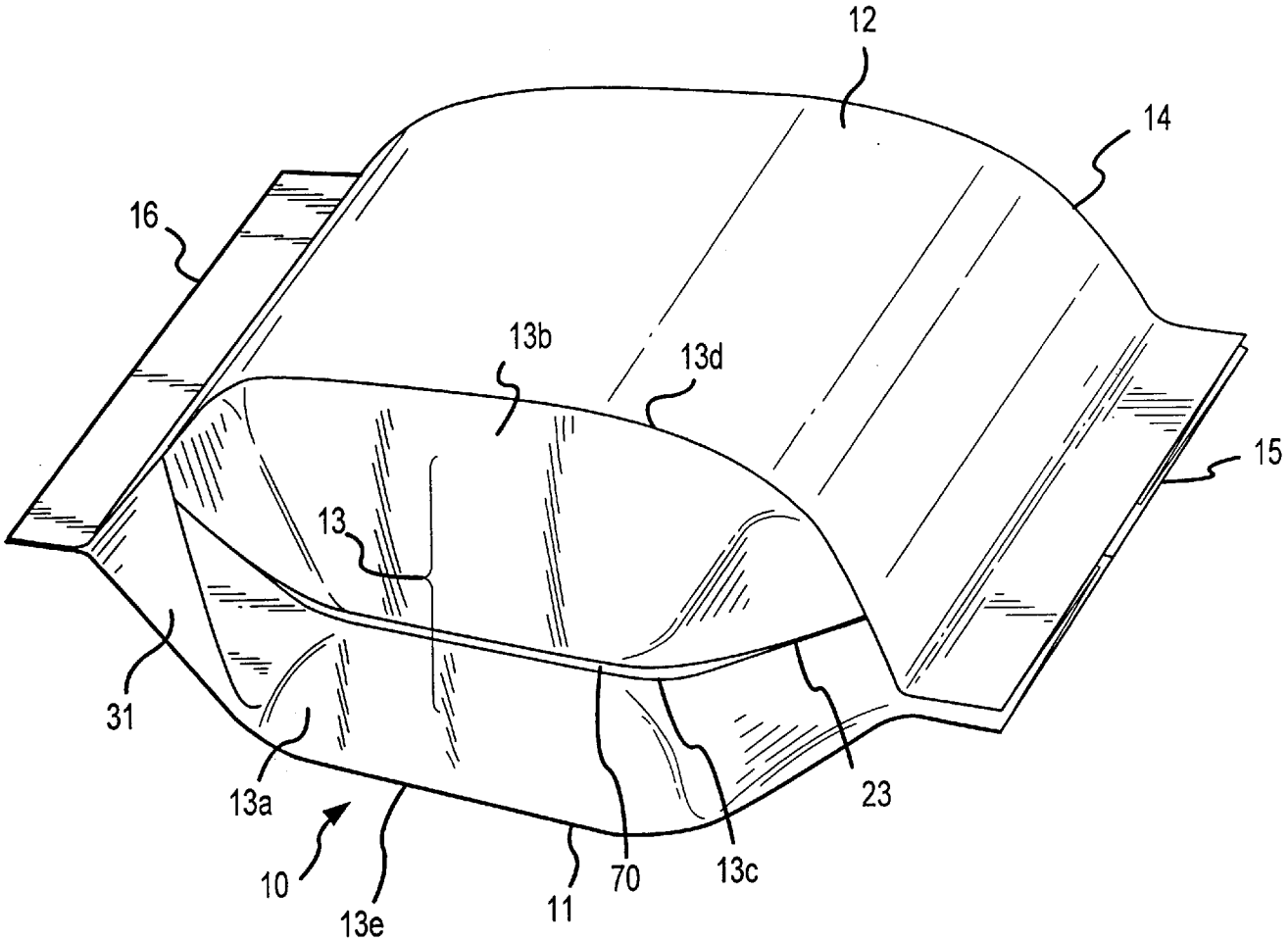
FIG. 2 is a perspective view of a food bag incorporating a gusset opening, wherein the gusset opening is formed along the longitudinal construction seam of the bag.

Referring specifically to flat blank 30, and as illustrated in FIGS. 5 and 6, the two longer edges of blank 30 (illustrated as top and bottom edges in FIGS. 5 and 6) eventually may be folded and sealed into respective ends 15 and 16 of bag 10, while the two shorter edges (illustrated as left and right edges in FIGS. 5 and 6) are eventually sealed to each other to create a longitudinal construction seam 23 of bag 10 (as illustrated in FIGS. 1 and 2). As illustrated in FIGS. 2, 4, 6, and 8, a first preferred construction technique may utilize longitudinal construction seam 23, in part or whole, as gusset opening 70. In this embodiment, seam 23/opening 70 preferably is sealed using one of a variety of techniques (as discussed above) which will keep seam 23/opening 70 sealed while further allowing a user to easily unseal gusset opening 70 to access the food product inside bag 10. In a secondary preferred construction technique, illustrated by FIGS. 1, 3, 5, and 7, gusset opening 70 may be constructed separately from longitudinal construction seam 23. In this secondary configuration, gusset opening 70 may be created by providing a sealed opening along a portion of fold 13*c*. In this configuration, seam 23 preferably is permanently sealed while gusset opening 70 preferably comprises a releasably secured opening or a mechanism which facilitates the creation of an opening between panel 13*a* and 13*b* (as discussed above).

It is important to note that many different construction techniques, flat blank configurations, and bag configurations may be used to create gusset 13 and corresponding gusset opening 70 on a surface of bag 10. For example, gusset 13 and corresponding gusset opening 70 could be incorporated into any face panel, end portion, or any other area of bag 10 without deviating from the scope of the invention. Furthermore, gusset 13 may comprise any number of gusset panels, and any number of gusset openings 70 between such panels. Moreover, gusset opening 70 need not be limited to an opening between two adjacent panels of gusset 13, but may comprise a removable set of panels within a multi-paneled configuration of gusset 13.

Accordingly, it should be understood that bag 10, featuring gusset opening 70, could be constructed using folding and sealing techniques different from those described herein without deviating from the scope of the invention. It also should be understood that bag 10 may be constructed using single or multiple ply construction and that gusset 13 and corresponding gusset opening 70 may be incorporated into many different types of food bags, including both microwavable and non-microwavable food bags. Moreover, while particular embodiments of the invention have been illustrated and described in detail herein, it should be understood that various changes and modifications may be made to the invention without departing from the spirit and intent of the invention as defined by the scope of the appended claims.

I claim:

1. A bag storing and dispensing a food product comprising a gusset formed on a portion of said bag, wherein said gusset comprises:

a first panel; and a second panel; and a gusset opening disposed between said first and said second panel and configured to facilitate access to the food product which is stored inside said bag; and said gusset opening comprises a first sealed seam; and said first seal seam is releasably sealed to secure said food product within said bag, further allowing a user to unseal said first sealed seam to gain access to said food product.

2. The bag of claim 1 further comprising a second sealed seam, wherein;

said second sealed seam is a longitudinal construction seam; and said first sealed seam is sealed less strongly than said second sealed seam, to secure the food product within said bag, and further allowing a user to unseal said first sealed seam to gain access to the food product.

3. The bag of claim 1 wherein said gusset opening comprises a means for facilitating the separation of a portion of said first panel from a portion of said second panel.

4. The bag of claim 1 further comprising a second gusset on said bag, wherein:

said second gusset substantially opposes said gusset opening; and said second gusset, when expanded, provides a stable base for resting said bag on a flat surface such that said gusset opening faces substantially upward.

5. The bag of claim 1 further comprising a vent means for release of gas and pressure during microwaving, wherein said gusset opening comprises said vent means.

6. A bag storing and dispensing a food product comprising a gusset formed on a portion of said bag, wherein said gusset comprises:

a first panel; and a second panel; and a gusset opening disposed between said first and said second panel and configured to facilitate access to the food product which is stored inside said bag; and said gusset opening comprises seal means for releasably securing said gusset opening, thereby securing said food product within said bag and further allowing a user to unseal said gusset opening to gain access to said food product.

7. A flat blank configured to construct a bag for storing and dispensing a food product comprising:

a first edge;

a second edge substantially opposing said first edge;

a first fold line substantially parallel to said first edge, said first fold line defining the portion of said flat blank between said first fold line and said first edge as a gusset panel;

a second fold line substantially parallel to said second edge, said second fold line defining a portion of said flat blank between said second fold and said second edge as a second gusset panel; and a third fold line between said first fold line and said second fold line, said third fold line defining a portion of said flat blank between said third fold line and said first fold line as a face panel, wherein said face panel comprises a heat enhancer.

8. A method for manufacturing a bag containing a food product and configured to dispense said food product, said bag being constructed from a flat blank and having a gusset opening, comprising the following steps:

folding said flat blank along a first fold line substantially parallel to a first edge of said flat blank, defining the portion of said flat blank between said first fold line and said first edge as a first gusset panel;

folding said flat blank along a second fold line substantially parallel to a second edge of said flat blank, defining the portion of said flat blank between said second fold line and said second edge as a second gusset panel;

coupling and releasably sealing said first edge to said second edge to form the gusset opening in the folded blank, wherein the end of the blank above and below the sealed gusset are unsealed ends;

sealing one of said unsealed ends of the folded blank to form the bag; and filling the bag with a food product through the remaining unsealed end and sealing said remaining unsealed end.

9. A method for using a bag to store and dispense a food product, said bag containing food contents and having a gusset opening, comprising the following steps:

placing said bag inside a microwave such that the bag lies on a face panel;

applying microwave radiation to the food contents within said bag;

removing said bag from said microwave oven;

rotating said bag so that said Russet opening is facing upward;

resting said bag on a substantially flat surface such that the bag supports itself in a stable position; and unsealing said gusset opening to gain access to the food contents.

* * * * *